United States Patent [19]

Hellums

[11] Patent Number: 4,890,052

[45] Date of Patent: Dec. 26, 1989

[54] TEMPERATURE CONSTANT CURRENT REFERENCE

[75] Inventor: James R. Hellums, Dallas, Tex.

[73] Assignee: Texas Instruments Incorporated, Dallas, Tex.

[21] Appl. No.: 228,352

[22] Filed: Aug. 4, 1988

[51] Int. Cl.[4] ..... G05F 3/20

[52] U.S. Cl. ..... 323/315; 323/312; 323/907

[58] Field of Search ..... 323/312, 315, 907

[56] References Cited

U.S. PATENT DOCUMENTS

| | | | |
|---|---|---|---|
| 4,029,974 | 6/1977 | Brokaw | 323/315 |
| 4,350,904 | 9/1982 | Cordell | 323/315 |
| 4,677,368 | 6/1987 | Bynum | 323/907 |
| 4,733,162 | 3/1988 | Haga et al. | 323/907 |
| 4,769,589 | 9/1988 | Rosenthal | 323/315 |
| 4,792,750 | 12/1988 | Yan | 323/315 |

*Primary Examiner*—Patrick R. Salce
*Assistant Examiner*—Jeffrey Sterrett
*Attorney, Agent, or Firm*—B. Peter Barndt; James I. Comfort; Melvin Sharp

[57] ABSTRACT

A temperature constant Gm current reference circuit which is also independent of voltage across the circuit which includes a circuit for applying a substantially identical voltage to a semiconductor diode as well as to a branch circuit comprising a polysilicon resistor of predetermined doping level in series with plural unidirectional current carrying devices connected in parallel, preferably in the form of a multi-electrode transistor. From eight to twelve such unidirectional current carrying devices are required in the preferred embodiment.

14 Claims, 1 Drawing Sheet

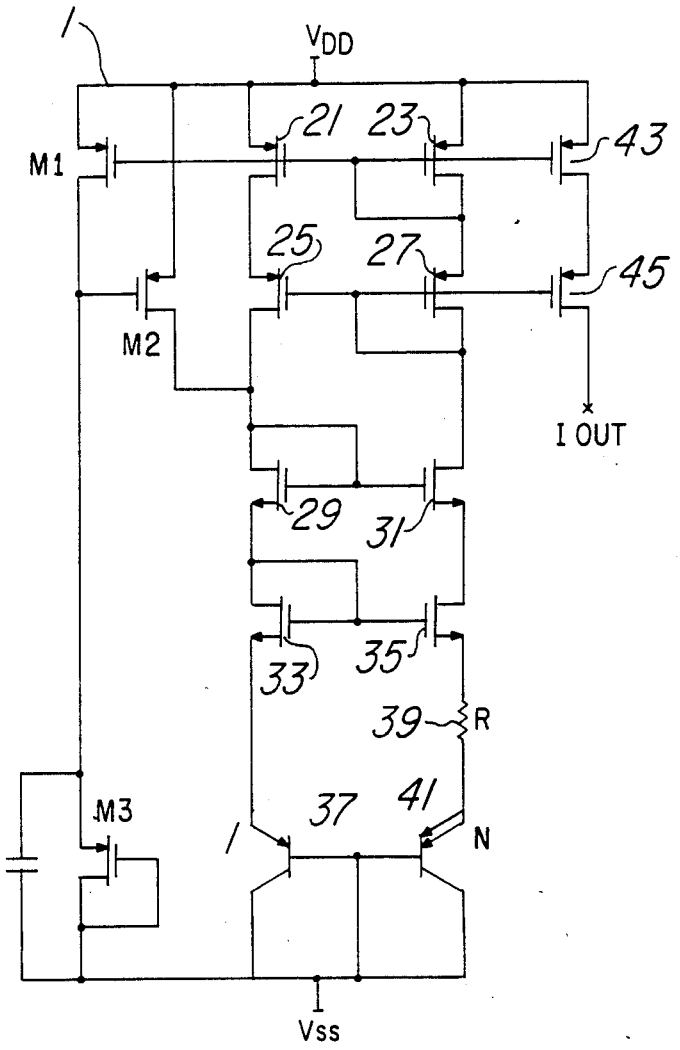
1
VDD
21
23
43
M1
25
27
45
M2
I OUT
29
31
33
35
39
R
M3
37
41
1
N
Vss

TEMPERATURE CONSTANT CURRENT REFERENCE

CROSS REFERENCE TO RELATED APPLICATIONS

This application is related to Ser. No. 228,344, filed Aug. 4, 1988 of James R. Hellums which is incorporated herein by reference.

BACKGROUND OF THE INVENTION

1. Field Of The Invention

This invention relates to a temperature constant Gm current reference source.

2. Brief Description Of The Prior Art

In switched capacitor filter design, in order to have well controlled high frequency response, it is desirable to have the gain-bandwidth product of the amplifiers constant. This allows the amplifiers in the filter to settle always in the same amount of time. This is important because such filters are based upon sampling with a set clock period. If the gain-bandwidth product decreases with temperature increase, for example, it takes the amplifiers longer to settle. If the settling time is too long during a clock period, then inaccuracies will develop in the filter. For example, the Q of the filter will degrade, leading to frequency response errors and possible non-linear distortion problems. If the gain-bandwidth product of the amplifier, on the other hand, increases and becomes too large, then, while the signal will settle with sufficient rapidity and AC response will be proper, the total noise in the filter will increase due to the amplifier noise bandwidth increasing, thereby decreasing the signal-to-noise ratio of the system. It is therefore desirable to maintain constant bandwidth.

The common effect between settling and noise in the filter is the gain-bandwidth of the amplifier. The gain-bandwidth of the amplifier is determined by the transconductance (Gm) of the input stage divided by the compensation capacitor. Since the compensation capacitor is temperature stable, then Gm must also be made temperature stable. It is therefore necessary that a temperature stable current reference be provided which stabilizes Gm of a MOSFET over the temperature range to be encountered to the first order.

The equation for the gain-bandwidth (G.B.W.) of an amplifier is the transconductance (Gm) of the input stage thereof divided by the capacitance (C) of the compensation capacitor ($G.B.W.=Gm/C$). Since the capacitance of the compensation capacitor is independent of temperature, as stated above, it is necessary to stabilize the transconductance (Gm) of the amplifier to achieve the desired result. It is therefore necessary to obtain a current which will stabilize the transconductance of the MOSFET therein. The transconductance of a MOSFET is proportional to the square root of its own mobility term multiplied by the current flowing therethrough where is ($Gm=(2uC_o(W/L)I)E0.5$), where u is mobility as a function of temperature ($u(T)=uo(T/To)E-1.5$) where uo is u at To=300 degrees Kelvin and $C_o$ is the oxide capacitance per unit area of the MOSFET, where $I=kT\ ln(N)/qR$ and where $R=R_o[1+TCR(T-300)]$. From this relation and with Gm(T) being a constant, a close approximation of the current with TCR=−1667 ppm is $I(T)=(KT\ ln(N))/qRo[1+TCR(T-300)]$, where K is Boltzmann's constant,N is the ratio of the diodes in one leg of the current mirror to the diode in the other leg thereof and q is the electronic charge. The mobility term has a known physical dependance which operates according to the 3/2 power inverse law. Therefore, a current is required which will operate as a positive 3/2 power so that when the transconductance and current terms are multiplied together there is no temperature dependance.

SUMMARY OF THE INVENTION

In accordance with the present invention, the above noted problem of the prior art is minimized and there is provided a temperature constant Gm CMOS current reference which is relatively simple and inexpensive to fabricate.

Briefly, the above is accomplished by providing a source of equal voltage to two circuit branches extending to the same reference voltage source. The source of equal voltage includes two parallel circuits, one between Vdd and a PNP transistor connected as a diode and the second between Vdd and the series combination of a resistor and plural diodes connected in parallel. These two parallel circuits include a first complementary circuit in series with the diode and the other circuit including a second complementary circuit in series with the resistor and parallel connected diodes. The p-channel devices of each circuit are coupled to Vdd with their common gates coupled to the junction of the complementary devices in series with the polysilicon resistor and plural diodes connected in parallel.

The n-channel devices of each circuit have their common gates coupled to the junction of the complementary transistors in series with the diode. The branch comprising the PNP transistor is connected as a single diode with its base and collector coupled to the reference voltage source. The second branch comprises, in series, a resistor having a negative temperature coefficient of resistance and a plurality of diodes connected in parallel between the resistor and the reference voltage source. The preferred number of parallel connected diodes is from 8 to 12. A multiple emitter transistor is a preferred manner of obtaining the parallel connected diodes, the multiple emitter transistor preferably having between 8 and 12 emitters with the base and collector electrodes thereof coupled to the reference voltage source.

The result is that the total voltage across the single diode is equal to the voltage across N diodes connected in parallel in series with the resistor having a negative temperature coefficient of resistance. Therefore the voltage across the resistor is equal to the difference of the voltage across the single diode and the voltage across the N diodes connected in parallel. The current in the second branch is therefore equal to delta Vbe/R, this being a known physical equation and being equal to (kT/qR)ln(N), where k is Boltzmann's constant, T is absolute Temperature in degrees Kelvin, q is the electronic charge, R is the resistance of the resistor R and N is the number of diodes (or the number of emitters where a multiple emitter transistor is used) in the circuit, preferable between 8 and 12.

The resistor is preferably formed of polysilicon and doped to an appropriate doping level to provide the desired negative temperature coefficient of resistance. The desired resistance is a function of geometry. It is known that the temperature coefficient of resistance and the resistivity of polysilicon are functions of the doping density thereof. For example, a doping density of polysilicon which provides a resistivity of about 500 ohms per square also provides a temperature coefficient of resistance thereof which substantially matches that of a pn junction. The resistance of the polysilicon resistor is determined by a first order approximation by the formula $R(T)=Ro(1+TCR\ delta\ T)$ where TCR is $-2100$ ppm/°C. and delta $T=T-To$, where Ro is the resistance at 300 degrees Kelfin and To=300 degrees Kelvin.

It can be seen from the above noted physical equation that, with temperature T increasing, the term T increases and R simultaneously goes negative (due to the negative temperature coefficient of resistance), thereby increasing the value of current I even more. In this way, the temperature dependence of Gm is obtained as shown in the above noted equations.

BRIEF DESCRIPTION OF THE DRAWING

The FIGURE is a circuit diagram of a preferred embodiment of a temperature constant Gm CMOS current reference in accordance with the present invention.

DESCRIPTION OF THE PREFERRED EMBODIMENT

Referring now to the FIGURE, there is shown a temperature constant Gm current reference circuit in accordance with the present invention. While other circuits can also perform this requirement and form a part of this invention, the circuit depicted herein is preferred because the current reference therein is independent of the power supply in that the desired current will be provided regardless of the supply voltage above some minimum design value. Also, though CMOS circuits generally have a processing dependence on the Vt of the MOS devices, the present circuit is provided in CMOS technology, yet is independent of the Vt of either the n-channel or p-channel devices therein.

The circuit 1 includes two pairs of p-channel transistors 21, 23 and 25, 27 with the sources of transistors 21, 23 connected to Vdd and their drains connected to the sources transistors 25, 27 respectively. The drains of transistors 25, 27 are connected to the drains of n-channel transistors 29, 31 respectively, the sources of which are connected to the drains of n-channel transistors 33, 35 respectively. The sources of transistors 33, 35 each provide identical voltage therefrom to reference voltage source Vss via the intermediary circuits connected therebetween as will be explained hereinbelow. The gates of transistors 21, 23 are coupled together as well as to the junction of the drain of transistor 23 and the source of transistor 27. The gates of transistors 25, 27 are coupled together as well as to the junction of the drain of transistor 27 and the drain of transistor 31. The gates of transistors 29, 31 are coupled together as well as to the junction of the drain of transistor 25 and the drain of transistor 29. The gates of transistors 33, 35 are coupled together as well as to the junction of the source of transistor 29 and the drain of transistor 33.

The source of transistor 33 is coupled to Vss through a PNP transistor 37 which is connected as a diode with the base and collector thereof coupled to the reference voltage source Vss. The source of transistor 35 is coupled to Vss through a polysilicon resistor 39 which is doped to provide the desired temperature coefficient of resistance in the manner described hereinabove which is in series with a multi-emitter transistor 41 which acts as plural parallel connected pn junction diodes. The resistance of resistor 39 is set to the desired value by geometrical means. In the preferred embodiment, from eight to twelve such emitters are present, though only two are shown in the drawing.

The current in each of the p-channel transistors is the same because they are equally sized and must return the same current since each pair has a common gate-to-source voltage. The n-channel transistors operate as simple differential amplifiers since each transistor pair has the same amount of current in its drain and the gates of each transistor pair are at the same potential. Accordingly, the current through each n-channel transistor must be the same. This forces the voltage at the sources of transistors 33 and 35 to be equal. The voltage now forced across the intermediate circuits from these equal voltage sources of devices 33 and 35 to Vss must be the diode voltage since the diode 37 cannot support any other voltage. It follows that, since the voltage across resistor 39 and multi-emitter transistor 41 is known and the resistance thereof is known, the current therethrough is also known.

Since zero current flow is a stable operating state for the circuit of the FIGURE, it is necessary that a start-up circuit be provided to ensure that the reference current actually is present in the circuit. Such start up circuitry is shown by p-channel transistors M1, M2 and M3 and capacitor C1 wherein transistors Ml and M3 are serially connected between Vdd and Vss with the gate of transistor M1 being coupled to the gates of transistors 21 and 23 and the gate of transistor M3 being coupled to the drain thereof which is also at Vss. Transistor M2 is coupled between Vdd and the junction of transistors 25 and 29 with the gate thereof being coupled to the junction of transistors M1 and M3. The start up circuit initially forces current into the reference circuit and then shuts itself down and is taken out of the circuit.

In operation, when a voltage is applied to the circuit at Vdd relative to Vss, as the voltage across the circuit increases, there is no current flowing in transistors 21, 23, 25, 27, 29, 31, 33 and 35. Therefore transistor M1 is turned off while transistor M3 is on and acting as a large resistor. So, as Vdd continues to increase relative to Vss, the gate of transistor M2 will remain near Vss through the resistive action of transistor M3. Capacitor C1 will help to hold the gate of transistor M2 near Vss under fast transients of Vdd relative to Vss. When Vdd has reached a p-channel Vt relative to Vss, transistor M2 turns on and begins to charge up the gates of transistors M29 and M31. When the voltage across the circuit reaches two p-channel Vsat voltage drops plus two n-channel Vt voltage drops plus a diode voltage drop (this being the voltage drop across transistors 21, 25, 29, 33 and 37 or about 2.5 volts), current will begin to flow with the value of the diode voltage impressed across the resistor 39 and multi-emitter transistor 41. When transistor M2 turns on, it forces current into the node at the junction of transistors 29 and 33 and pulls up the drain voltage on the n-channel devices 29 and 33, thereby turning these transistors on as soon as the diode breakdown voltage thereof is reached since they are connected as diodes. This will cause current to flow through resistor 39 and multi-emitter transistor 41 due to the application of current to the gates of transistors 31 and 35. This current is returned to the upper mirror (transistors 21, 23, 25 and 27) and turns on the upper mirror transistors as well as transistor M1. This pulls up the voltage on the gate of transistor M2 and turns transistor M2 off. Accordingly, transistor M2 no longer injects current into the voltage reference circuit at the junction of transistors 25 and 29 with the reference circuit now operating at its reference current level which is stable and need not be further monitored.

It can be seen that there has been provided a temperature constant Gm CMOS current reference circuit which is simple in design, economical and independent of voltage thereacross.

Though the invention has been described with respect to a specific preferred embodiment thereof, many variations and modification will immediately become apparent to those skilled in the art. It is therefore the intention that the appended claims be interpreted as broadly as possible in view of the prior art to include all such variations and modifications.

We claim:

1. A temperature constant Gm current reference circuit comprising:

(a) a unidirectionally conducting semiconductor device coupled to a reference voltage source;

(b) a branch circuit comprising a polysilicon resistor having a negative temperature coefficient of resistance and having a predetermined doping level and a plurality of parallel connected unidirectional current carrying elements serially connected to said resistor, said branch circuit being coupled at one end thereof to said reference voltage source; and (c) means to apply a substantially identical voltage across each said semiconductor device and said branch circuit.

2. A temperature constant Gm current reference circuit as set forth in claim 1 wherein said means to apply substantially identical voltage comprises a pair of p-channel transistors, each said transistor being coupled to a source of voltage and a pair of n-channel transistors coupled between said p-channel transistors and said semiconductor device and branch circuit to form a pair of parallel circuits, each said parallel circuit containing one of said p-channel and one of said n-channel transistors and one of said semiconductor device and branch circuit.

3. A temperature constant Gm current reference circuit as set forth in claim 2 wherein said plurality of parallel connected unidirectional current carrying devices is from 8 to 12.

4. A temperature constant Gm current reference circuit as set forth in claim 2 further including start-up circuit means to initiate current flow in said reference circuit responsive to a predetermined voltage thereacross.

5. A temperature constant Gm current reference circuit as set forth in claim 4 wherein said plurality of parallel connected unidirectional current carrying devices is from 8 to 12.

6. A temperature constant Gm current reference circuit as set forth in claim 1 further including start-up circuit means to initiate current flow in said reference circuit responsive to a predetermined voltage thereacross.

7. A temperature constant Gm current reference circuit as set forth in claim 6 wherein said plurality of parallel connected unidirectional current carrying devices is from 8 to 12.

8. A temperature constant Gm current reference circuit as set forth in claim 1 wherein said plurality of parallel connected unidirectional current carrying devices is from 8 to 12.

9. A temperature constant Gm current reference circuit comprising:

a unidirectional conducting semiconductor device coupled to a reference voltage source;

a branch circuit comprising a polysilicon resistor having a negative temperature coefficient of resistance and having a predetermined doping level and a plurality of parallel connected unidirectional current carrying elements serially connected to said resistor, said branch circuit being coupled at one end thereof to said reference voltage source;

a first pair of p-channel transistors, each of said first pair of p-channel transistors being coupled to a source of voltage;

a second pair of p-channel transistors, each of said second pair of p-channel transistors being coupled to a different one of said first pair of p-channel transistors; and a first pair of n-channel transistors coupled to a different one of said second pair of p-channel transistors, each said second n-channel transistor being coupled between a different one of said first n-channel transistors and a different one of said semiconductor device and branch circuit.

10. A temperature constant Gm current reference circuit as set forth in claim 9 wherein said plurality of parallel connected unidirectional current carrying devices is from 8 to 12.

11. A temperature constant Gm current reference circuit as set forth in claim 9 wherein said plurality of parallel connected unidirectional current carrying devices is from 8 to 12.

12. A temperature constant Gm current reference circuit comprising:

a unidirectional conducting semiconductor device coupled to a reference voltage source;

a branch circuit comprising a polysilicon resistor having a negative temperature coefficient of resistance and having a predetermined doping level and a plurality of parallel connected unidirectional current carrying elements serially connected to said resistor, said branch circuit being coupled at one end thereof to said reference voltage source;

a first pair of p-channel transistors, each of said first pair of p-channel transistors being coupled to a source of voltage;

a second pair of p-channel transistors, each of said second pair of p-channel transistors being coupled to a different one of said first pair of p-channel transistors;

a first pair of n-channel transistors coupled to a different one of said second pair of p-channel transistors and a second pair of n-channel transistors, each said second n-channel transistor being coupled between a different one of said first n-channel transistors and a different one of said semiconductor device and branch circuit; and startup circuit means to initiate current flow in said reference circuit responsive to a predetermined voltage thereacross.

13. A temperature constant Gm current reference circuit as set forth in claim 12 wherein said plurality of parallel connected unidirectional current carrying devices is from 8 to 12.

14. A temperature constant Gm current reference circuit as set forth in claim 12 said plurality of parallel connected unidirectional current carrying devices is from 8 to 12.

* * * * *

UNITED STATES PATENT AND TRADEMARK OFFICE

CERTIFICATE OF CORRECTION

PATENT NO. : 4,890,052

DATED : December 26, 1989

INVENTOR(S) : James R. Hellums, William R. Krenik

It is certified that error appears in the above-identified patent and that said Letters Patent is hereby corrected as shown below:

On the title page item [75] Inventor: Please add the second inventor's name as follows:

-- William R. Krenik --.

Signed and Sealed this

Seventeenth Day of March, 1992

*Attest:*

HARRY F. MANBECK, JR.

*Attesting Officer*

*Commissioner of Patents and Trademarks*